United States Patent [19]

Beers

[11] Patent Number: 5,067,322

[45] Date of Patent: Nov. 26, 1991

[54] REFRIGERATOR WITH SPINE FIN EVAPORATOR

[75] Inventor: David G. Beers, Evansville, Ind.

[73] Assignee: General Electric Company, Louisville, Ky.

[21] Appl. No.: 593,750

[22] Filed: Oct. 5, 1990

[51] Int. Cl.[5] ..... F25B 39/02

[52] U.S. Cl. ..... 62/515; 62/452; 165/184

[58] Field of Search ..... 62/187, 440, 452, 515; 165/184

[56] References Cited

U.S. PATENT DOCUMENTS

| | | | |
|---|---|---|---|
| 2,453,448 | 11/1948 | McTurk | 165/184 |
| 3,688,375 | 9/1972 | Venables, III | 29/202 D |
| 3,909,898 | 10/1975 | Hicks | 29/157.3 AH |
| 4,122,687 | 10/1978 | McKee | 62/187 |
| 4,545,428 | 10/1985 | Onishi et al. | 165/184 |

*Primary Examiner*—Albert J. Makay
*Assistant Examiner*—John Sollecito
*Attorney, Agent, or Firm*—Radford M. Reams; H. Neil Houser

[57] ABSTRACT

A refrigerator has a compartment to be refrigerated and a refrigerant evaporator normally operable at frost producing temperatures to refrigerate the compartment. The evaporator includes an elongated tube to receive refrigerant with an elongated spine fin ribbon wrapped in an open spiral about and in intimate heat exchange contact with the tube. The ribbon includes an elongated base with a continuous series of fingers projecting outwardly of the tube along each edge of the base. The space between adjacent passes of ribbon is greater than the width of the base.

12 Claims, 2 Drawing Sheets

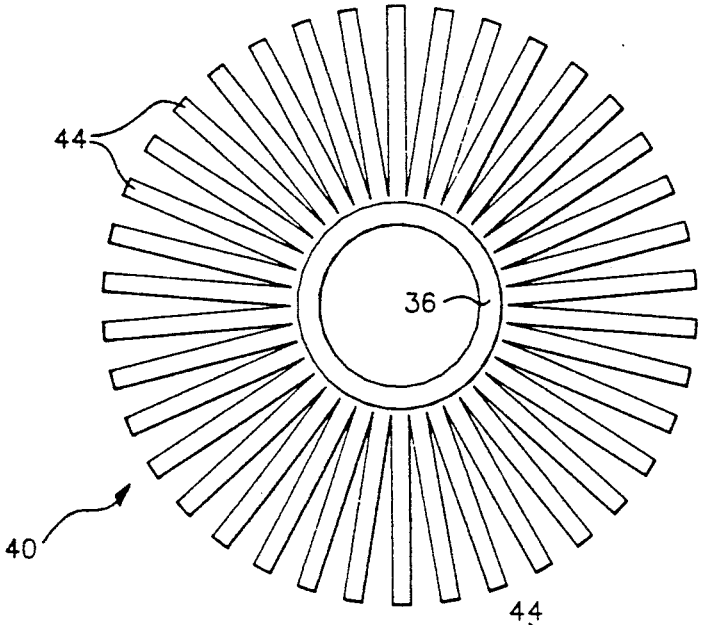
FIG. 2
FIG. 3
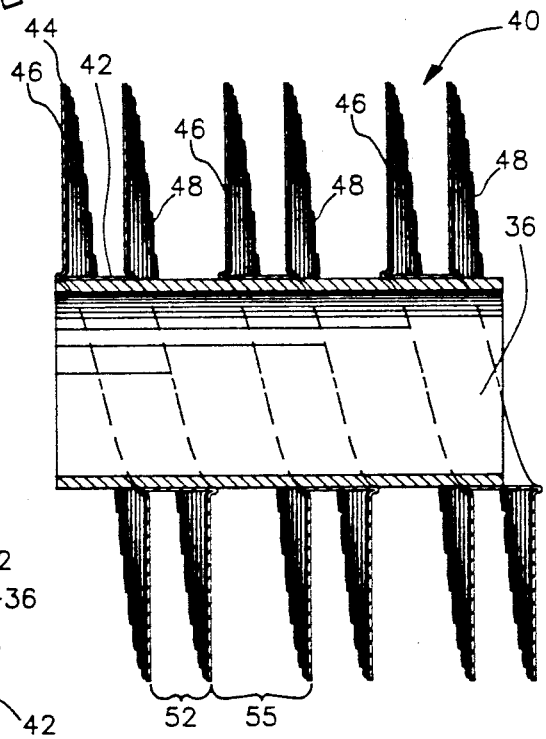
FIG. 4
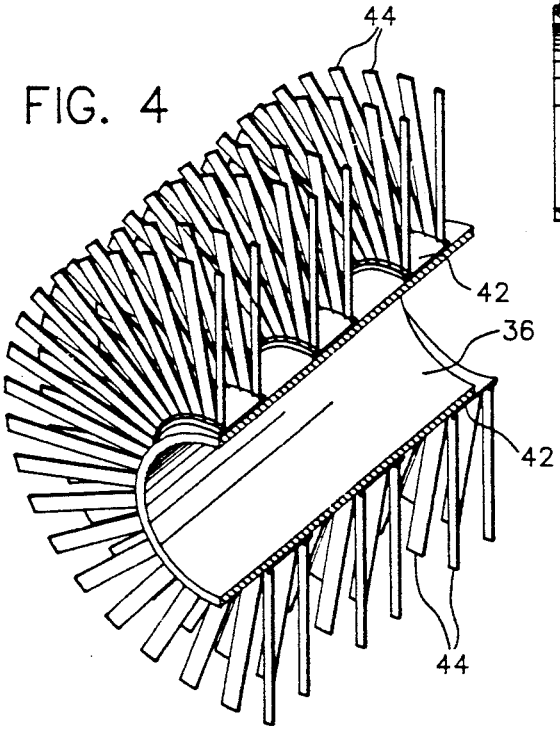

REFRIGERATOR WITH SPINE FIN EVAPORATOR

BACKGROUND OF THE INVENTION

For many years spine fin tubing has been used in heat exchange structures for air conditioners. In such heat exchangers the spine fin ribbon is wrapped about the evaporator tubing in a very tight knit fashion; that is, the spine fin ribbon is wound so that adjacent passes of ribbon are in contact and the fingers or spines are very closely spaced. With such a construction the spines or fingers provide a very large total surface area for heat transfer. At the same time the spines or fingers are so closely spaced that the overall structure acts much like a cylinder during manufacture. One attribute of that construction is that the spines are mutually supportive and resist being depressed or folded over when the tube is handled. One reason that air conditioner heat exchangers can use spine fin tubing with closely packed, very thin spines is that during normal operation they are not subjected to a build up of frost (frozen condensation).

Despite the successful use of spine fin tubing in air conditioners for many years, such heat exchange structures have not been used in refrigerator evaporators. It has been the belief of many experienced practitioners that spine fin materials are not suitable for use in refrigerator evaporators. One basis for the belief was that the frost build up in a refrigerator evaporator quickly would render the spine fin ineffective as a heat transfer structure. In addition it was believed that the spine fin structure, as used in air conditioners, was too delicate to withstand the handling involved in manufacturing and installing refrigerator evaporators. On the other hand it was believed that, if the size of the spines were increased sufficiently to withstand the rigors of manufacturing, then the evaporator would not have sufficient heat exchange capacity to be effective with the stringent size limitations normally imposed upon such evaporators.

Accordingly, it is an object of this invention to provide an improved refrigerator with an evaporator incorporating a spine fin heat exchange structure.

It is another object of this invention to provide such an improved structure in which the spine fin ribbon is wrapped about the evaporator tubing in an open spiral.

It is yet another object of this invention to provide such an improved structure in which the distance between adjacent passes of ribbon and the width of the base of the ribbon are asymmetric.

Further objects and advantages of the present invention will be apparent from the following description and features of novelty which characterize the invention will be pointed out in the claims attached to and forming a part of this specification.

SUMMARY OF THE INVENTION

In accordance with one form of this invention a refrigerator has a compartment to be refrigerated and an evaporator normally operated at frost producing temperature to refrigerate the compartment. The evaporator includes elongated tubing to carry refrigerant and an elongated spine fin ribbon wrapped in intimate heat transfer contact about the tubing in an open spiral configuration. The ribbon is formed with a base having a substantially continuous series of fingers projecting outwardly of the tubing along each lateral edge of the base. The pitch of the open spiral wrap is sufficiently large that the distance between adjacent passes of ribbon is greater than the width of the base of the ribbon.

BRIEF DESCRIPTION OF THE DRAWINGS

FIG. 2 is a cross-sectional view taken laterally of the tubing of FIG. 1;

FIG. 3 is a fragmentary cross-sectional view taken longitudinally of the tube of FIG. 1; and FIG. 4 is a fragmentary perspective view of the tube of FIG. 1, partly broken away.

DESCRIPTION OF THE PREFERRED EMBODIMENTS

Figure 1:
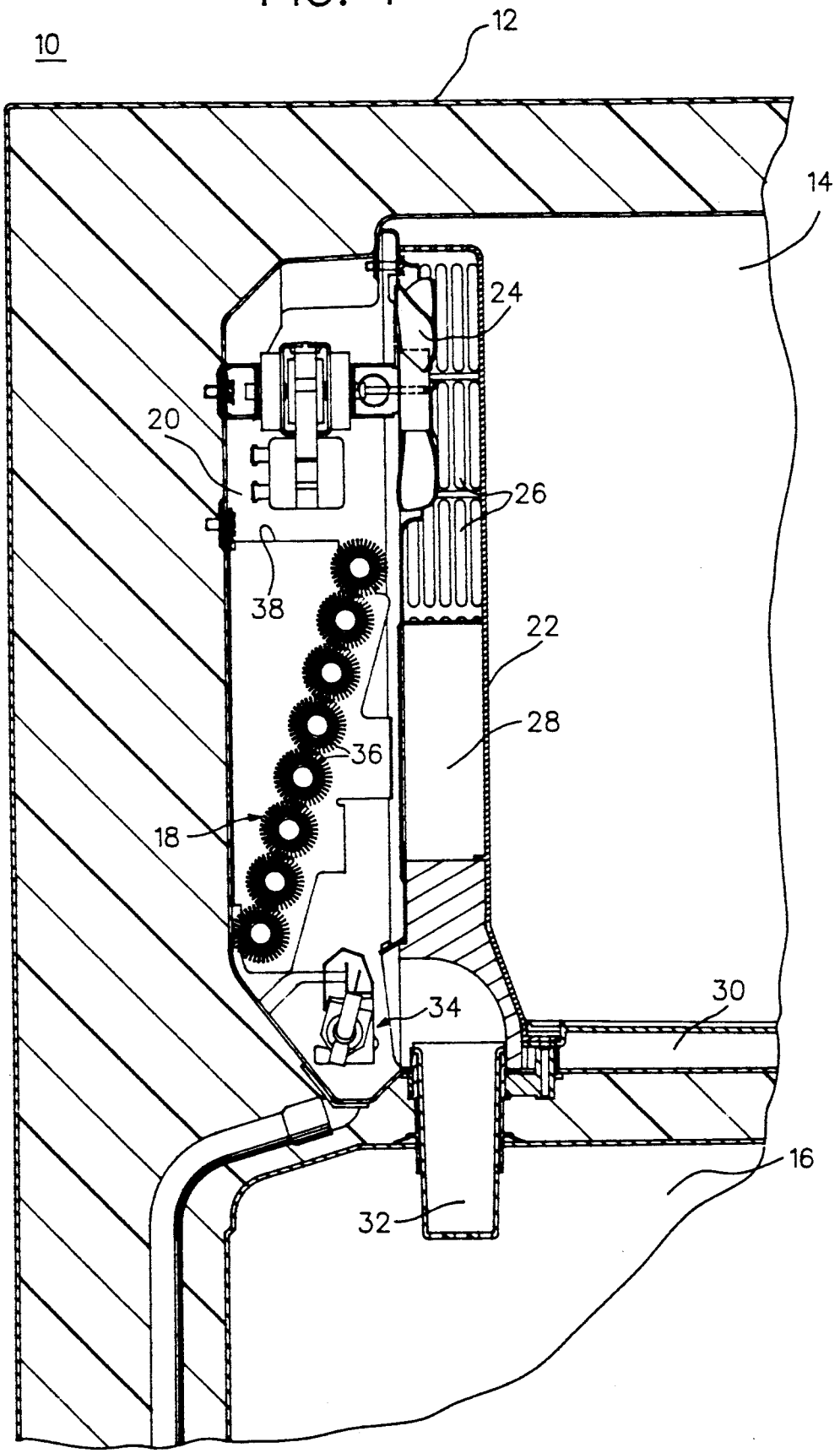
FIG. 1 is a fragmentary cross-sectional side elevation view of a refrigerator incorporating one embodiment of the present invention.

Referring now to FIG. 1, a refrigerator 10 includes an outer cabinet 12 containing a freezer compartment 14 and fresh food compartment 16. The freezer compartment 14 is maintained at sub-freezing temperatures and the fresh food compartment 16 at above freezing-food preserving temperatures by circulating air through these compartments and over an evaporator 18 positioned in a vertically disposed evaporator chamber 20 positioned behind the freezer compartment 14 and separated from it by wall structure 22. More specifically, a fan 24 positioned in the upper portion of the evaporator chamber or compartment 20 discharges air through openings 26 in the wall 22 into the freezer compartment 14 and through a passage, partially shown at 28, to the fresh food compartment 16. The fan also draws air from within the freezer compartment 14 and fresh food compartment 16 back into the evaporator compartment 20 and over the evaporator. The return air from the freezer compartment flows through a passage partially shown at 30 while the air returned from the fresh food compartment flows through passage 32. The freezer compartment 14 is maintained below freezing while the fresh food compartment 16 is maintained above freezing by an appropriate division of air being discharged from the evaporator compartment 20, with the majority of the air going to the freezer compartment 14 and a smaller portion of the air going to the fresh food compartment 16.

In order to maintain the freezer compartment 14 at sub-freezing temperatures, it is necessary that the evaporator 18 operate at below freezing temperatures, with the result that moisture contained in the air flowing through the evaporator chamber 20 collects on the outer surfaces of the evaporator in the form of frost. Periodically this accumulated frost is removed from the evaporator surfaces by energizing a heater 34 positioned in radiant and convection heating relationship with the evaporator surfaces.

Refrigerator evaporators transfer heat from the air passing over the outside of the evaporator surface to the refrigerant flowing through the inside of the evaporator so as to cool the air. A typical refrigerator evaporator consists essentially of an elongated tube carrying refrigerant which is bent or formed into a serpentine configuration in order to fit in a more confined space and, thus, take up less room in the refrigerated compartments of a refrigerator. In order to enhance the heat transfer characteristic of the evaporator it is well known to provide some kind of fins extending outwardly from the tube to increase the surface area for transfer. With refrigerator evaporators, particularly those which provide cooling for freezing compartments, it is necessary for the evaporator structure to provide effective heat transfer even though a considerable body of frost has built up around the evaporator tubing. To this end, the greater the space provided between adjacent fins or adjacent rows of fins the longer effective air flow past the evaporator will take place. On the other hand, larger fin spacings reduce the number of fins and the total available heat transfer surface area.

In the evaporator 18, a tube 36 is formed and disposed in a fashion well known in the art. That is, the tube 36 is bent in the form of a serpentine to provide a plurality of horizontal conduit passes disposed in a vertical spaced arrangement connected by return bends. The overall layout of the evaporator 18 is a generally rectangular construction with the various passes of the tube 36 supported in spaced relationship on opposed frame members, one of which is shown at 38, at opposite sides of the evaporator 18. The frame members 38 mount the evaporator 18 in a generally vertical position within the evaporator chamber or compartment 20 but slightly angled with respect to the vertical to more fully expose the horizontal passes of the tube 36 to the return air flowing upwardly through the evaporator compartment 20.

The radiant heater 34 is periodically energized to warm the evaporator surfaces to defrosting temperatures. This heater conveniently may be of the type disclosed in co-pending application Ser. No. 07/593,749, filed on Oct. 5, 1990, and assigned to General Electric Company, assignee of the present invention.

As best seen in FIGS. 2, 3 and 4, the evaporator 18 includes an elongated spine fin ribbon 40 wound or wrapped about the outer surface of tube 36 in an open spiral configuration. That is, each pass (one circumferential circuit around the tube) of the ribbon 40 is spaced apart from the longitudinally adjacent passes of the ribbon. More specifically, the ribbon includes a base 42 and a plurality of spines or fingers 44. The fingers 44 are arranged in rows 46 and 48 along the lateral edges of the base 42. Each of the rows 46 and 48 is formed of a substantially continuous series of fingers 44. That is the fingers are formed adjacent to each other without significant spacings between them where they join the base 42. When wrapped around the tube 36, as shown in FIGS. 2–4, the fingers extend outwardly from the outer surface of the tube 36 adjacent the lateral edges of the ribbon base 42 and, preferably, they are disposed generally perpendicular to the outer surface tube 36.

In a preferred embodiment of the invention, the pitch of the ribbon wrap, that is the number of windings of ribbon per longitudinal unit length of the tube is such that the adjacent passes are spaced apart, as indicated at 55. Preferably, the spaces 55 between adjacent passes and the width of the ribbon base 42 or distance between the rows of fingers 46 and 48, as indicated at 52, are asymmetric. This asymmetric spacing of the rows of fingers enhances the ability of the spine fin evaporator to continue to effectively transfer heat from the air to the refrigerant as frost builds up around the tubing 36. In household refrigerator evaporators subject to frost build-up, spacing between 0.030 inch and 0.550 inch is preferred.

In a preferred embodiment of the present invention, the spines or fingers 44 are sized to optimize the effective available heat transfer surface while providing sufficient strength for the essentially free-standing fingers that the manufacturing process does not materially depress or bend over so many fingers as to adversely affect the subsequent operation of the evaporator. In a particular embodiment, in which the evaporator tube has an outer diameter of 0.375 inch, the fingers were 0.350 inch long (that is in the dimension perpendicular to the tube 36), 0.033 inch wide (that is in the direction generally circumferential of the tube 36) and 0.009 inch thick (that is in the direction longitudinally of the tube 36). In a preferred embodiment of the present invention, both the evaporator tube and spine fin structure were made from aluminum; however, other materials may be used. In household refrigerator evaporators subject to frost build-up, fins or fingers between about 0.050 inch and 4.00 inches long; between about 0.010 inch and 0.200 inches wide and between about 0.008 inch and 0.030 inch thick are preferred.

While there has been shown and described what is presently considered to be a preferred embodiment of the present invention, it is to be understood that the invention is not limited thereto and is intended in the appending claims to cover all such changes and modifications as fall within the true spirit and scope of invention.

What is claimed is:

1. A refrigerator having at least one compartment to be refrigerated and a refrigerant evaporator normally operable to refrigerate said at least one compartment; said evaporator including an elongated evaporator tube to receive refrigerant and an elongated ribbon of spine fin material wound in an open spiral about the outer surface of said tube and in intimate heat transfer relationship with said outer surface of said tube.

2. A refrigerator as set forth in claim 1 wherein said ribbon of spine fin material includes an elongated base strip in intimate heat transfer relationship with said tube and a continuous series of fingers extending generally perpendicularly outward from said tube along at least one edge of said base.

3. A refrigerator as set forth in claim 2 wherein said fingers are between 0.050 inch and 4.00 inches long, 0.010 inch and 0.200 inch wide and 0.008 inch and 0.030 inch thick.

4. A refrigerator as set forth in claim 1 wherein said ribbon of spine fin material includes an elongated base in intimate heat transfer relationship with said tube a continuous series of fingers extending generally perpendicularly outward from said tube along the lateral edges of said base.

5. A refrigerator as set forth in claim 1 where in the spacing between longitudinally adjacent passes of ribbon is asymmetric relative to the distance between the fingers extending from opposite sides of said base.

6. A refrigerator as set forth in claim 4 wherein the distance longitudinally of said tube between adjacent passes of said ribbon is asymmetric relative to the width of said ribbon base.

7. A refrigerator as set forth in claim 4 wherein the distance longitudinally of said tube between adjacent passes of ribbon is between about 0.030 inch and 0.550 inch.

8. A refrigerator having a compartment to be refrigerated and a refrigerant evaporator normally operable at frost collecting temperatures to refrigerate said compartment; said evaporator including an elongated tube to receive refrigerant and an elongated spin fin ribbon wrapped about said tube in an open spiral configuration; said ribbon including an elongated base strip in intimate heat transfer contact with said tube and a substantially continuous series of fingers projecting outwardly of said tube along the lateral edges of said base.

9. A refrigerator as set forth in claim 8 wherein the pitch of the spiral wrap of said ribbon is asymmetric relative to the distance between the rows of fins on opposite sides of said ribbon.

10. A refrigerator as set forth in claim 8 wherein the pitch of the spiral wrap of said ribbon is asymmetric relative to the distance between the rows of fingers on opposite sides of said ribbon base.

11. A refrigerator as set forth in claim 10 wherein said fingers are between 0.050 inch and 4.00 inches long, between 0.010 inch and 0.200 inch wide and between 0.008 inch and 0.030 inch thick.

12. A refrigerator as set forth in claim 10 wherein the distance longitudinally of said tube between adjacent passes of ribbon is between about 0.030 inch and 0.550 inch.

* * * * *